US006799340B2

(12) United States Patent
Schatz

(10) Patent No.: US 6,799,340 B2
(45) Date of Patent: Oct. 5, 2004

(54) HOLDING BRACKET FOR BED SIDE RAILING

(75) Inventor: William M. Schatz, Rome, NY (US)

(73) Assignee: Bed Safety Consulting, Inc., Rome, NY (US)

( * ) Notice: Subject to any disclaimer, the term of this patent is extended or adjusted under 35 U.S.C. 154(b) by 0 days.

(21) Appl. No.: 10/337,033

(22) Filed: Jan. 6, 2003

(65) Prior Publication Data

US 2004/0128760 A1 Jul. 8, 2004

(51) Int. Cl.[7] ..... A47C 21/08
(52) U.S. Cl. ..... 5/425; 5/430
(58) Field of Search ..... 5/425, 428, 429, 5/430, 427, 507.1, 503.1, 662

(56) References Cited

U.S. PATENT DOCUMENTS

| | | | | |
|---|---|---|---|---|
| 2,195,955 A | | 4/1940 | Hillenbrand | |
| 2,496,068 A | | 4/1950 | Rutkowski | |
| 2,587,291 A | | 2/1952 | Des Rochers | |
| 2,601,015 A | | 6/1952 | Gruber | |
| 2,648,850 A | | 8/1953 | Warren | |
| 2,929,078 A | | 3/1960 | Smith et al. | |
| 2,979,738 A | | 4/1961 | Goldberg | |
| 3,012,255 A | | 12/1961 | Diehl | |
| 3,069,700 A | | 12/1962 | Berlin | |
| 3,179,957 A | | 4/1965 | Norton | |
| 3,476,346 A | | 11/1969 | Oakes | |
| 3,486,176 A | | 12/1969 | Murcott | |
| 3,742,527 A | | 7/1973 | Johnston et al. | |
| 3,823,428 A | | 7/1974 | Whyte | |
| 3,855,654 A | | 12/1974 | Pivacek | |
| 4,221,012 A | | 9/1980 | Harris | |
| 4,439,880 A | | 4/1984 | Koncelik et al. | |
| 4,676,687 A | | 6/1987 | Koffler | |
| 4,724,559 A | * | 2/1988 | Bly et al. | 5/425 |
| 5,335,385 A | | 8/1994 | Brown | |
| 5,599,130 A | | 2/1997 | Solomon et al. | |

* cited by examiner

*Primary Examiner*—Alexander Grosz
(74) *Attorney, Agent, or Firm*—George R. McGuire; Bond, Schoeneck & King, PLLC

(57) ABSTRACT

A support assembly for mounting to a bed to position protective railings along the sides of the bed comprises one or more support members of flat, rigid material such as sheet metal. The support members are attached to the bed deck of a hospital bed or the frame of a standard bed with inwardly facing surfaces of the support members on opposite sides of the bed spaced by substantially the width of the mattress. A hollow sleeve is affixed to the support member to receive a terminal end of the railing. Relative dimensions and positional relationships are such that gaps between the rails and portions of the bed or mattress are minimized to reduce the possibility of a patient becoming wedged in such a gap. The side rail supports are essentially immune from mispositioning due to poor training, errors or carelessness of personell attending to the bed and patient.

15 Claims, 9 Drawing Sheets

FIG. 5
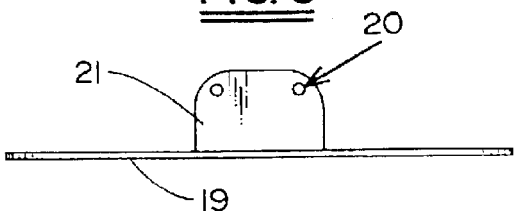
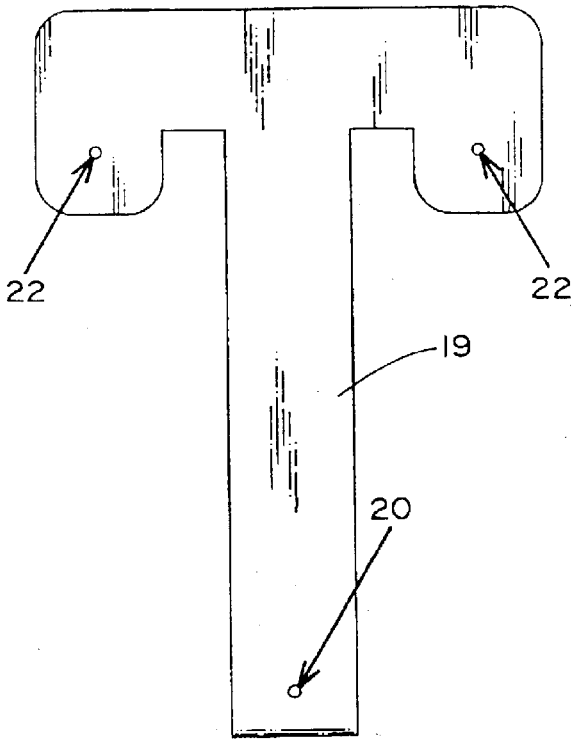
FIG. 6
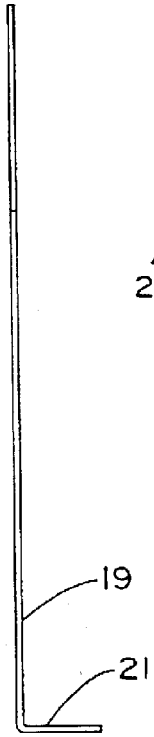
FIG. 7
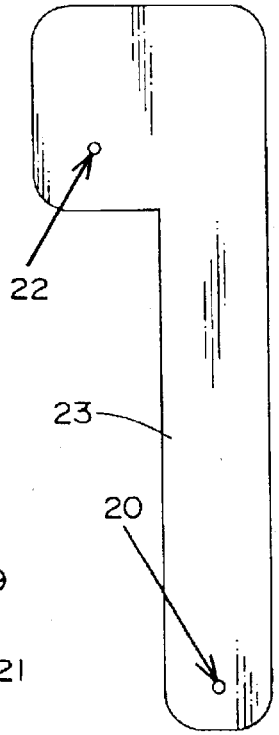
FIG. 8

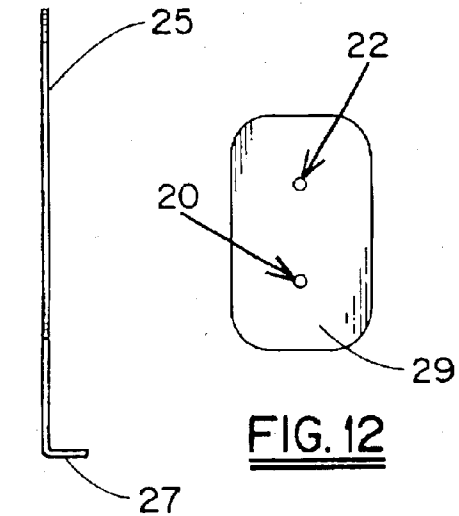
FIG. 11
FIG. 12
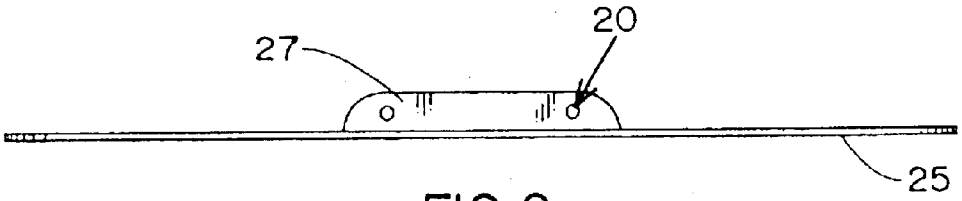
FIG. 9
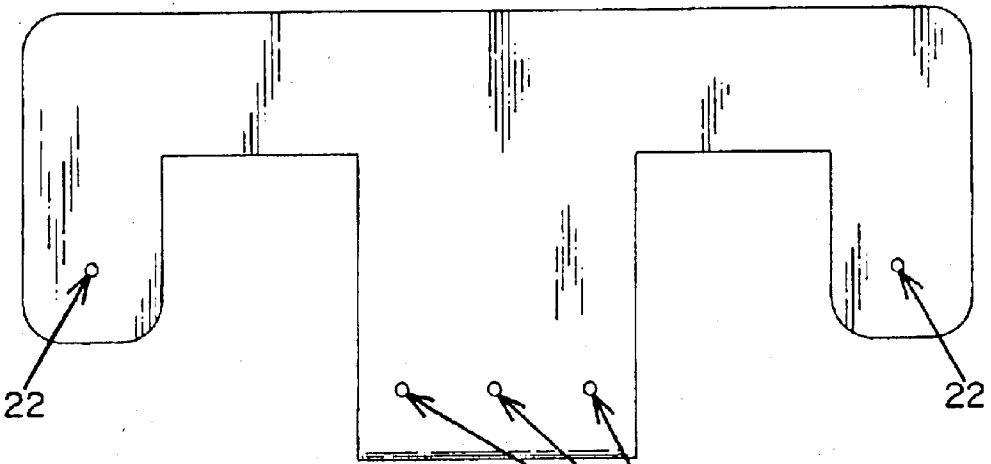
FIG. 10

HOLDING BRACKET FOR BED SIDE RAILING

BACKGROUND OF THE INVENTION

The present invention relates to hardware for attachment to portions of a bed in order to hold protective railings along the sides of the bed. More particularly, the invention relates to fixtures or brackets for permanent or detachable connection to a side rail of a conventional bed frame or to the deck of a hospital bed for improved mounting of side rails extending along the sides of the bed.

Side rails are conventionally mounted upon beds of geriatric patients or others requiring such restraints through the use of crossbars extending between the mattress and box springs, or by other means which are subject to leaving gaps between the railing and portions of the bed. As sometimes happens, it is possible for a person in the bed to extend portions of the body, or even the head through such gaps with resulting injury or even death. Although the rails may initially be installed in a manner which avoids such gaps, manipulation of the rails or of portions of the, bed or bedding in the normal course of attending to the patient or changing the bed may result in creating such gaps. In spite of training and instruction of personnel performing these tasks, positioning of the rails relative to other parts of the bed in a potentially dangerous manner still occurs. The problem is exacerbated by the typically high turnover rate of personnel performing such tasks and the fact that they are often entry level, part time employees.

It is a principal object of the present invention to provide a means of mounting side rails to a bed which greatly reduces the risk of dangerous gaps between portions of the bed and the rails.

It is a further object to provide mounting means for bed side rails which eliminates the use of conventional cross bars.

Another object is to provide hardware for supporting protective rails along the sides of beds which functions as lateral mattress stops.

A still further object is to provide a bed rail support structure which may be used with either standard beds or hospital beds in the secure mounting of protective side rails anywhere along the length of the beds.

Other objects will in part be obvious and will in part appear hereinafter.

SUMMARY OF THE INVENTION

In furtherance of the foregoing objects, the bed rail support structures of the invention comprise a first support member of rigid sheet metal or plastic having a major, flat body portion with a base extending at 90 degrees from a lower end thereof. The first support member is fixedly attached to the deck or frame of the bed either permanently, e.g., by riveting or welding, or detachably, e.g., with threaded fasteners, thereby holding the base and preferably a lower portion of the body portion in firm engagement with the bed deck or frame. A secondary support member is attached to the first support member and to the bed deck or frame to provide additional stability for the first support member. A hollow, cylindrical sleeve is detachably mounted to the first support member by a bolt extending through an opening in the support member and engaging a threaded aperture in the sleeve. The sleeve is mounted with its central axis positioned vertically and the axis of the threaded aperture horizontal. Assuming that protective rails are to be positioned on both sides of the bed, four such support structures are mounted to the bed, one on each side at the head and one on each side at the foot of the bed. End portions of the bed rails are inserted into the sleeves of each support structure and are releasably maintained by horizontal, spring loaded pins extending through the walls of the sleeves and into openings in the rail end portion.

The foregoing and other features of construction and operation of the bed rail support structure of the invention will be more readily understood and fully appreciated from the following detailed description, taken in conjunction with the accompanying drawings.

BRIEF DESCRIPTION OF THE DRAWINGS

FIGS. 5, 6 and 7 are top plan, front elevation and side elevation views of another element of the support structure;

FIG. 8 is a front elevation view of another element of the structure;

FIGS. 9, 10 and 11 are top plan, front elevation and side elevation views, respectively, of a modified version of the element of FIGS. 5–7;

FIG. 12 is a front elevation view of an element for use with the element of FIGS. 9–11;

DETAILED DESCRIPTION

Figure 1:
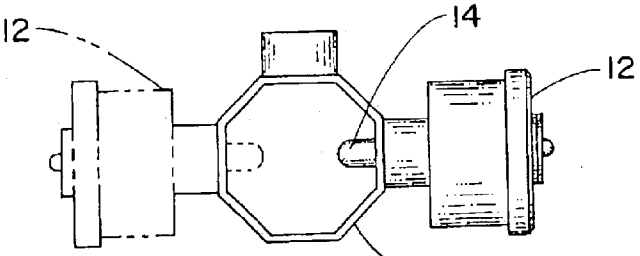
FIG. 1 is a top plan view of a portion of the bed rail guide portion of the support structure.
Figure 3:
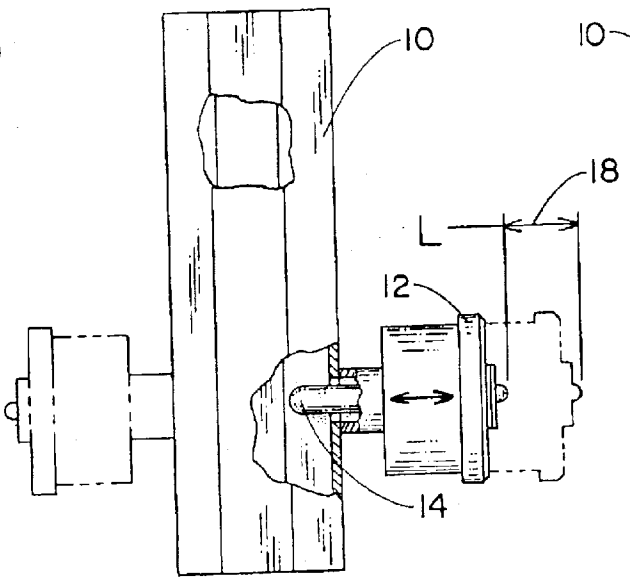
FIGS. 2, 3 and 4 are left side, front and right side elevation views, respectively, of the portion shown in FIG. 1.
Figure 4:
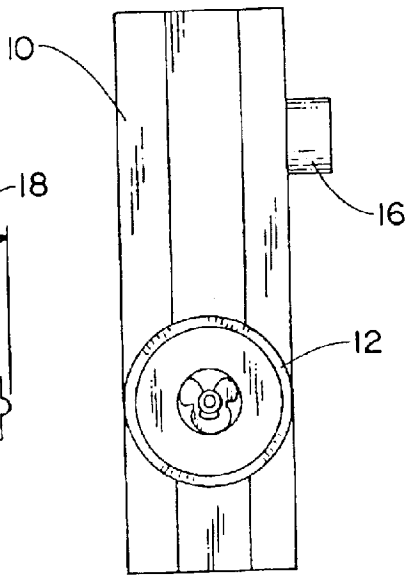
Figure 2:
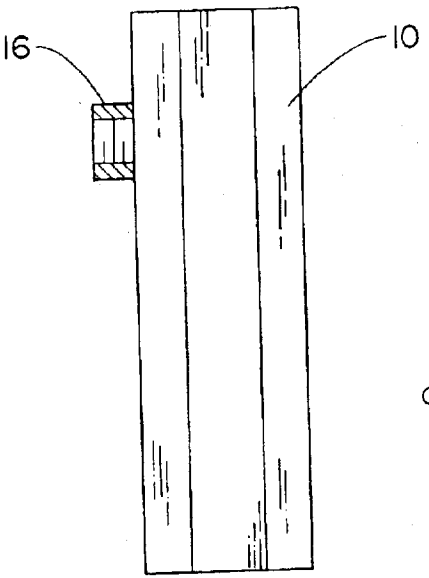

Referring now to the drawings, wherein like reference numerals denote like parts throughout the several views, in FIGS. 1–4 is shown a preferred embodiment of an element of the support structure of the invention comprising a hollow, cylindrical sleeve 10, a locking mechanism including manual gripping knob 12 for a spring loaded locking pin 14, and an internally threaded stub shaft 16. The locking device may be mounted in either or both of the positions indicated by solid and phantom lines, pin 14 being retractable by movement of knob 12 by distance L, indicated by reference numeral 18 in FIG. 3. As described later, when mounted to a bed with other elements of the support structure in its normal position of use, the central axis of sleeve 10 is positioned vertically and the axes of pin 14 and shaft 16 are horizontal.

In FIGS. 5–7 is shown another element of the structure, namely, a first support member having a generally T-shaped body portion 19 with base portion 21 extending integrally from the lower end thereof at 90 degrees to the major surfaces of body portion 19. Both body portion 19 and base 21 have through openings 20, and the body portion also includes through openings 22, the purposes of which will be described later. Second support member 23, shown in FIG. 8, also includes one each of openings 20 and 22.

A first modified form of the first support member is shown in FIGS. 9–11, comprising body portion 25 and base 27. Again, body portion 25 has both openings 20, in an area near base 27, and openings 22 near its outer extremities, whereas base 27 has a plurality of openings 20. A modified form of the second support member, denoted by reference numeral 29 and having one each of openings 20 and 22, is shown in FIG. 12.

Figure 13:
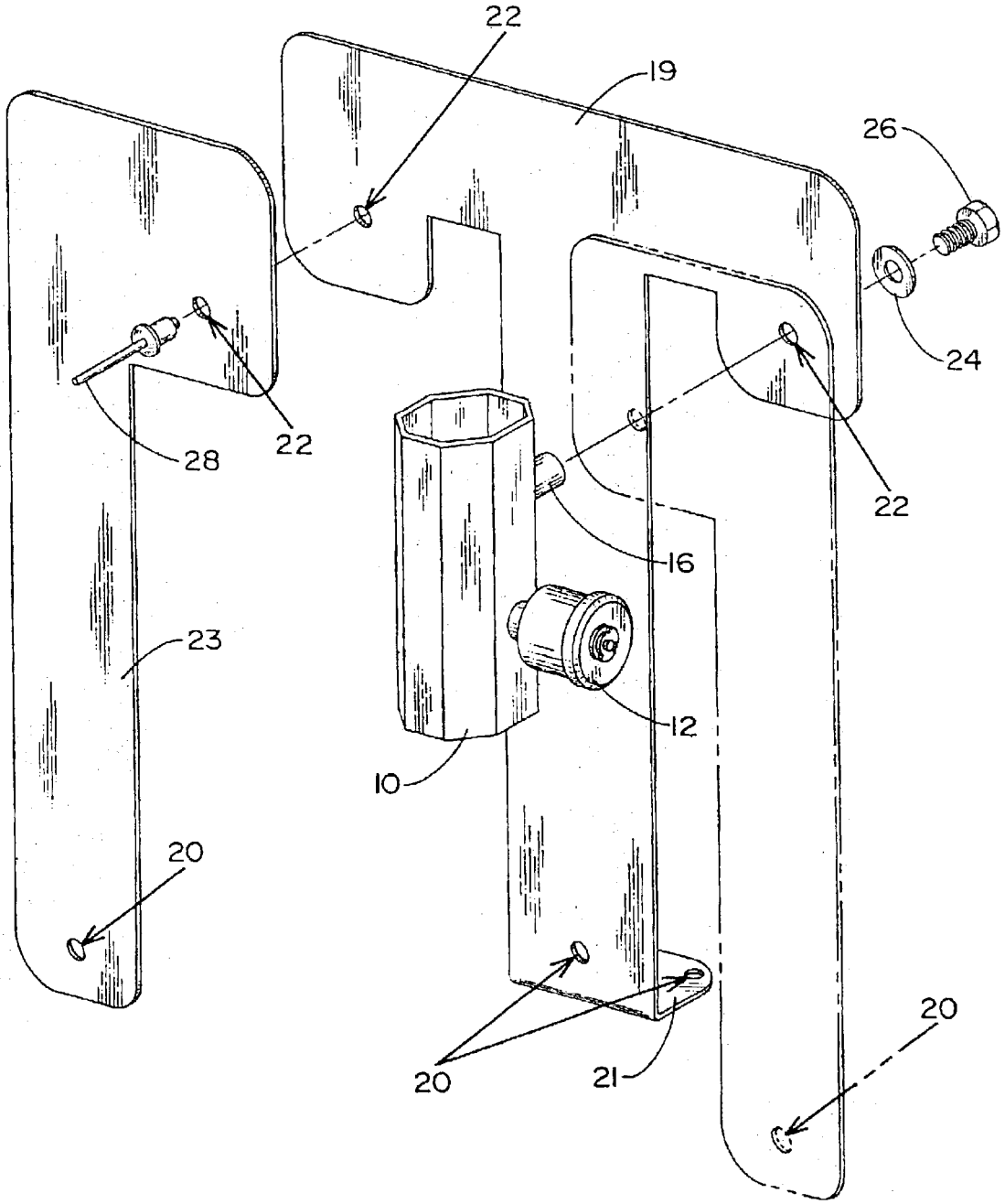
FIG. 13 is an exploded, perspective view of the support structure, including the elements of FIGS. 1–8.

Sleeve 10 and the first and second support members are shown in FIG. 13 in exploded perspective in their relative positions when assembled. Bolt 26 extends through washer 24 and one of openings 22 in body portion 19 and is received in the threads of shaft 16 to attach sleeve 10 to the first support member. The shaft 16 defines a pivot point between body protions 19 and cylindrical sleeve 10. Second support member 23 is attached to the first support member by another threaded fastener or by the illustrated pop rivet 28. Openings 20 are aligned with other openings in the horizontal and vertical portions of a bed frame or deck and other threaded fasteners or rivets are passed through the aligned openings to mount the support structure to a bed. When so mounted, sleeve 10 is in position to receive an end portion of a side rail for the bed, as shown and described later. Depending upon the desired position of the rail, the positions of sleeve 10 and second support member 23 may be reversed, as second support member 23 is shown in phantom lines.

Figure 14:
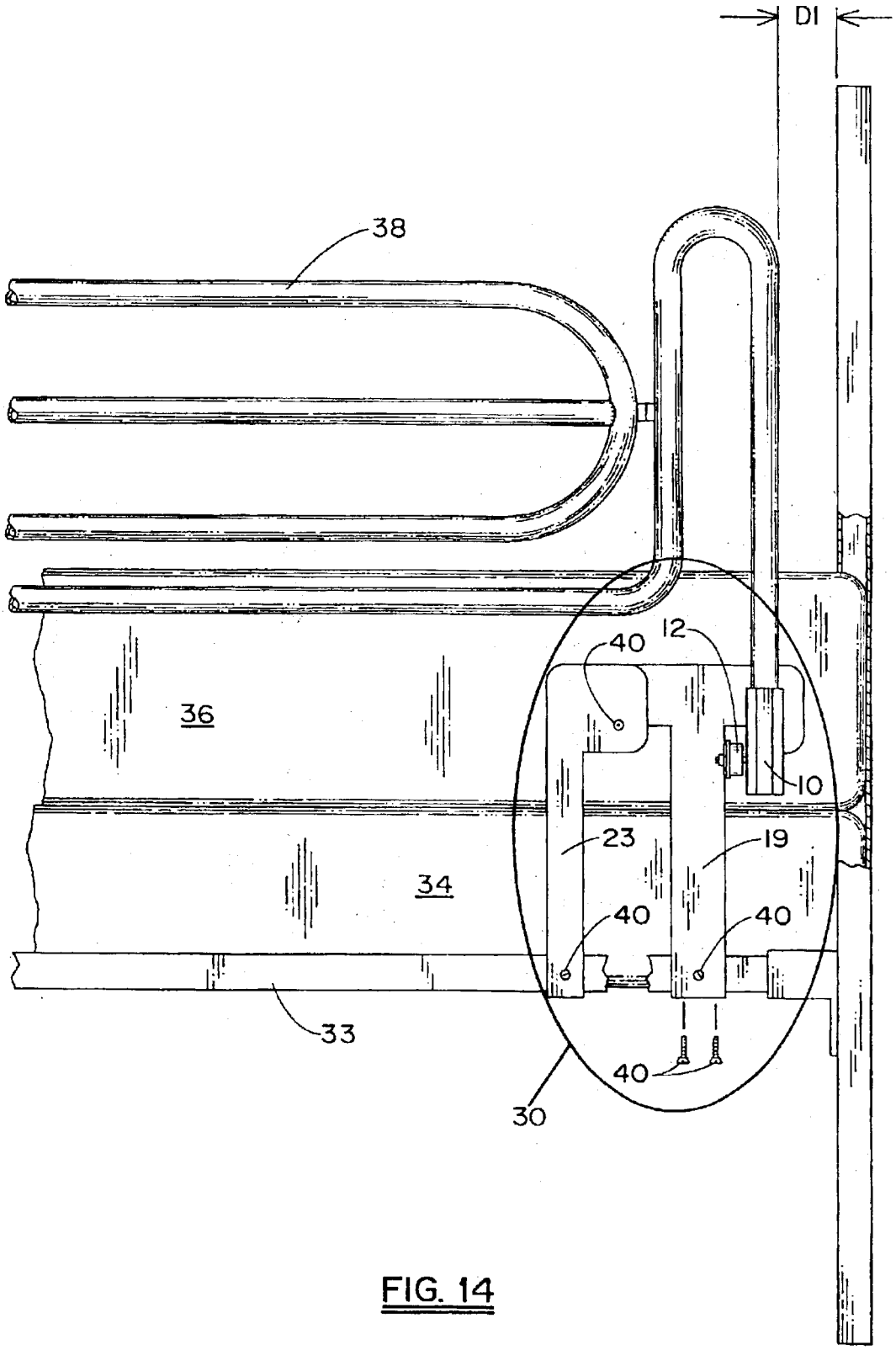
FIGS. 14 and 15 are fragmentary, side elevation views of the support structure of the invention holding a side rail and mounted to a bed at the head and foot, respectively.
Figure 15:
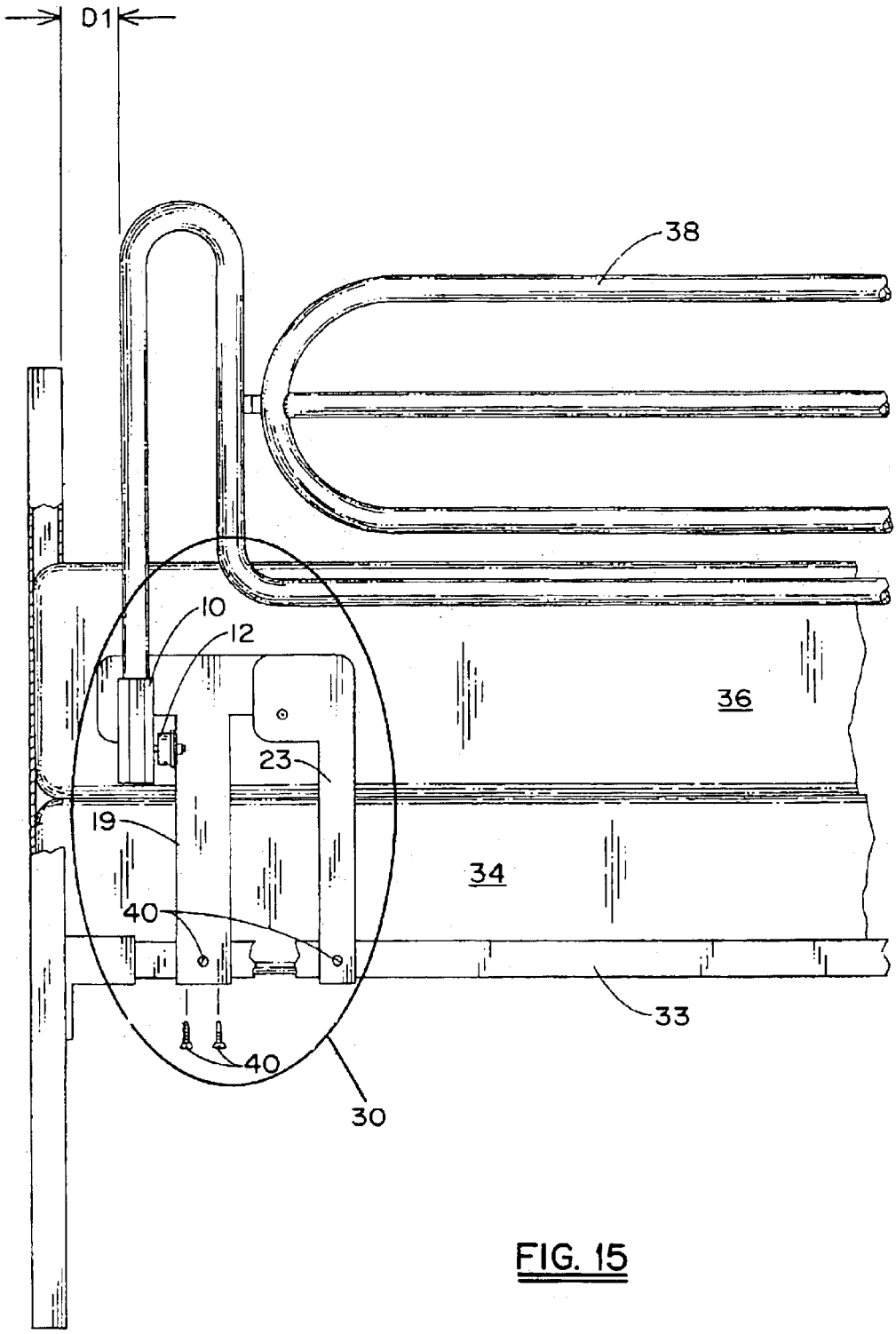

The fully assembled support structure 30 is shown in FIGS. 14 and 15 mounted to the head and foot, respectively, a bed having frame 33, box spring 34 and mattress 36. Sleeve 10 of each of the two support structures 30 holds an end portion of side rail 38 which is of conventional construction. The first and second support members are attached to the bed by threaded fasteners 40 which pass through aligned openings in the support members and frame 33, with the major surfaces of the support members facing toward and away from the longitudinal centerline of the bed. The portions of side rail 38 extending vertically from sleeves 10 are spaced a relatively small distance D1 (see FIGS. 14 and 15) from the head and foot boards of the bed, thus minimizing the possibility of the patient becoming wedged between portions of the rail and bed. In the plan view of FIG. 16 it will be noted that mattress 36 is essentially as wide as the space between the inwardly facing surfaces of the support members of the structures on opposite sides of the bed, i.e., the inwardly facing surfaces of the support members are spaced outwardly from the planes of the sides of the mattress only by the thickness of the bed frame (e.g., ¼") and thus serve as lateral stops for the mattress.

Figure 16:
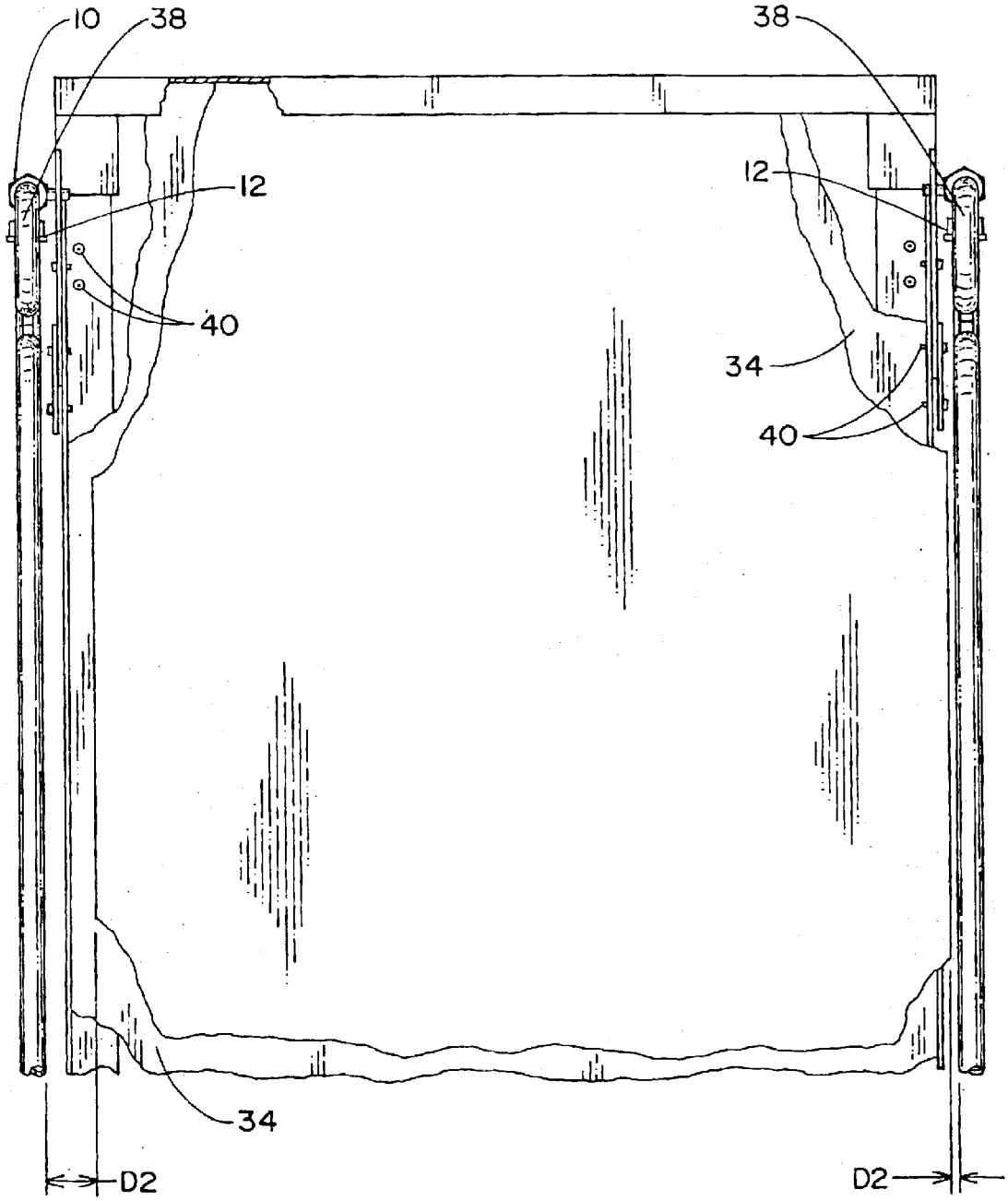
FIG. 16 is a fragmentary, top plan view of a portion of a bed with the support structure of the invention mounted and holding side rails on each side of one end of the bed.
Figure 17:
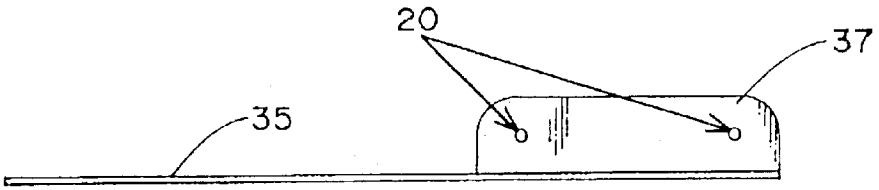
FIGS. 17, 18, and 19 are top plan, front elevation and side elevation views of a modified form of the support member of FIGS. 5–7.
Figure 18:
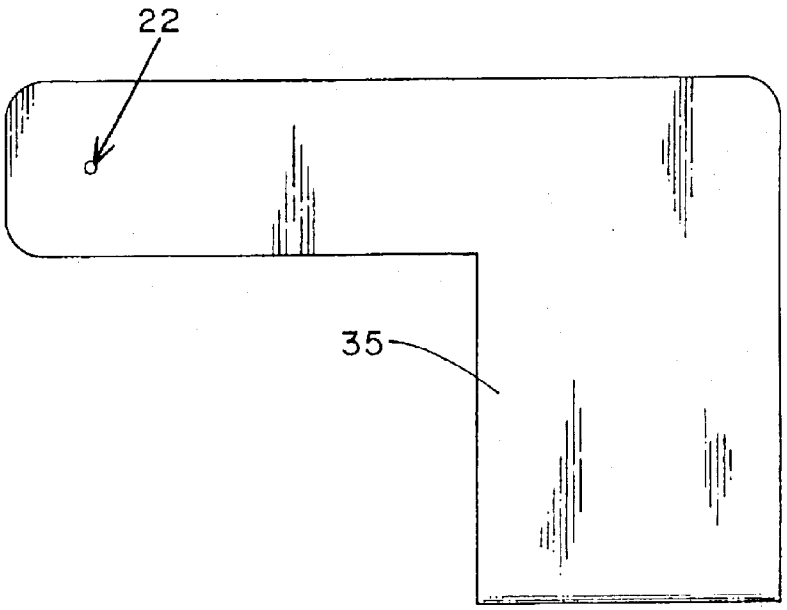
Figure 19:
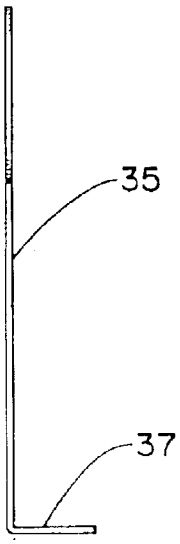
Figure 20:
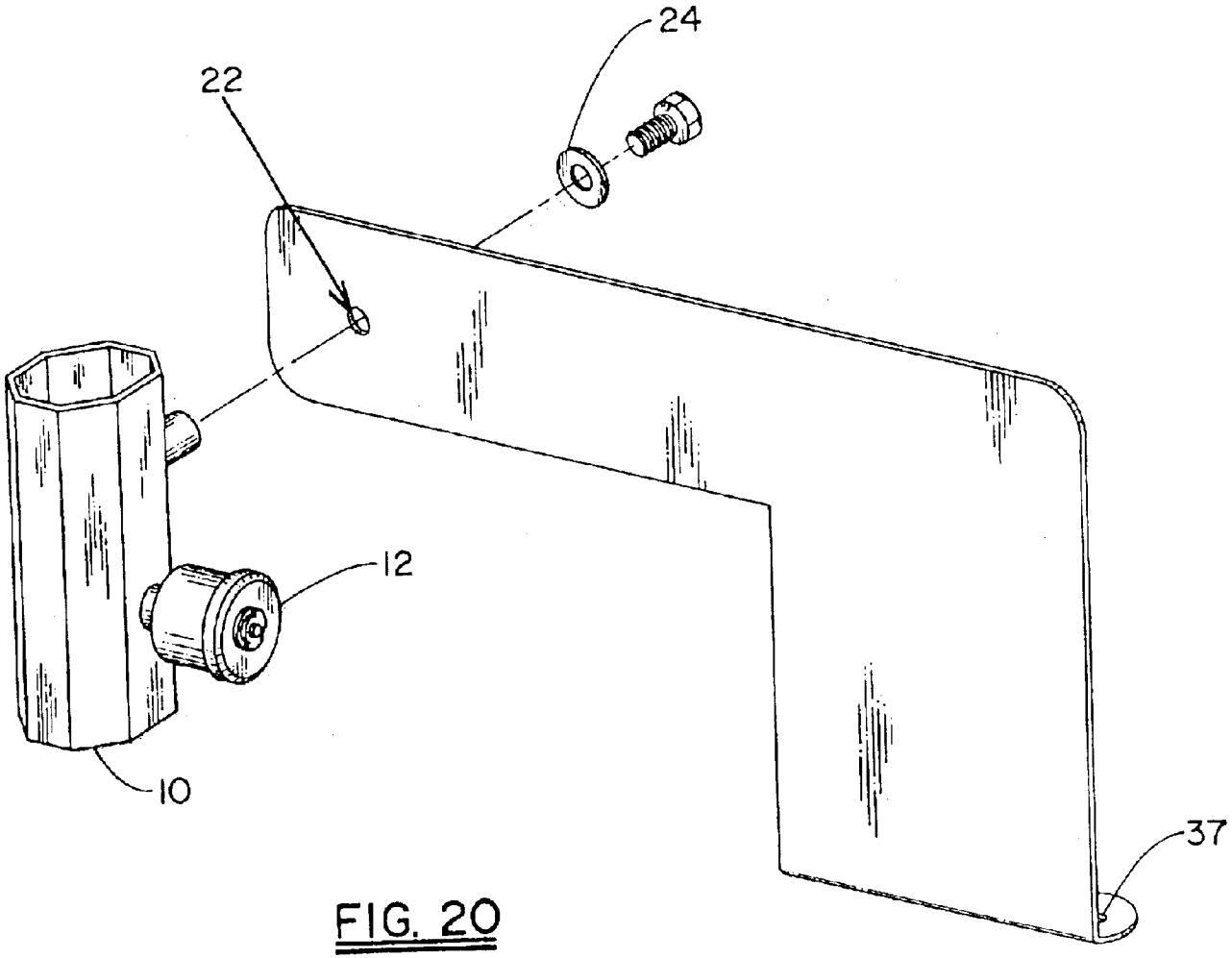
FIG. 20 is an exploded perspective view showing the support member of FIGS. 17–19 with the other elements of the support structure.

A second modified form of support member, comprising generally L-shaped body portion 35 with base portion 37 extending at 90 degrees from the lower end thereof, is shown in FIGS. 17–19. Base 37 has a pair of openings 20 for attachment of the support member to a bed frame or deck and body portion 35 has an opening 22 for attachment of a sleeve 10, as shown in the exploded perspective view of FIG. 20. The modified support members of FIGS. 9–12 and 17–20 are generally more suitable for attachment to the deck of a hospital bed, whereas the support members of FIGS. 5–8 are dimensioned for attachment to the frame of the standard bed, as seen in FIGS. 14–16. When the support structure is mounted to a hospital bed it may be desirable to make the connection permanent, in which case the bases of the first support members, i.e., bases 27 or 37, may be welded to the bed deck.

By making the support members of flat stock, e.g., sheet metal, having sufficient thickness to provide the necessary rigidity, and attaching these members to the bed essentially in the planes of the sides of the mattress, and by making shaft 16 relatively short, e.g., preferably one-half inch or less, the bed side rails are spaced outwardly from the sides of the mattress by a very small distance D2 (see FIG. 16), again enhancing the safety of the side rail support structure; that is, the very small distance from the side of the mattress to the side rail minimizes the risk of any physical portion of the patient becoming wedged between the side rails and mattress. It will also be obvious that the enhanced safety of the side rail support structure of the invention will not be diminished by any action of attendants, even those who may be inexperienced or careless.

What is claimed is:

1. A support assembly for mounting adjacent the four corners of a bed having a mattress supported thereon in order to hold protective side rails having opposite, terminal ends along each side of the bed, said support assembly comprising:

a) at least one support member of flat, substantially rigid material having opposite, major surfaces, wherein at least a portion of said at least one support member is adapted to prevent lateral movement of said mattress;

b) first means for attaching said support member to a portion of said bed at one side and adjacent one end thereof with said opposite surfaces of said support member facing toward and away from, respectively, the centerline of said bed;

c) a hollow sleeve having a central axis and opposite ends, at least one of said ends being open and dimensioned for insertion therein of one of said side rail terminal ends; and d) second means for detachably affixing said sleeve to said support member outwardly adjacent the surface facing away from the bed centerline with said axis positioned vertically and said open end facing upwardly to receive said side rail terminal end.

2. The support assembly of claim 1 wherein said first means comprises threaded fasteners passing through aligned openings in said support member and said portion of said bed.

3. The support assembly of claim 1 wherein said assembly includes first and second support members, means for attaching each of said support members to said portion of said bed and for attaching said support members to one another.

4. The support assembly of claim 3 wherein said means for attaching said support members to one another comprises fastening means extending through aligned openings in said first and second support members.

5. The support assembly of claim 4 wherein said first support member is generally T shaped.

6. The support assembly of claim 1 wherein said second means comprises a threaded fastener extending through an opening in said support member and into a threaded opening fixedly positioned with respect to said sleeve.

7. The support assembly of claim 6 and further including a hollow shaft fixedly secured to an outer surface of said sleeve and having internal threads providing said threaded opening.

8. The support assembly of claim 1 wherein said support member comprises a body portion with said major surfaces and a base portion extending integrally and perpendicularly from said body portion.

9. The support assembly of claim 8 wherein said first means comprise means for fixedly attaching said base portion to said portion of said body bed.

10. In combination with a bed having a head, foot, first and second sides and structure supporting a mattress of predetermined width, a plurality of support assemblies for positioned protective side rails having terminal ends along said first and second sides, one of said assemblies being mounted adjacent said head and said foot on each of said first and second sides, each of said assemblies comprising:

a) a first support member of essentially flat, rigid material having opposite major surfaces, wherein at least a portion of said first support member is adapted to prevent lateral movement of said mattress;

b) first fastening means connecting said first support member to said mattress supporting structure adjacent one of said head and foot at one of said first and second sides with said major surfaces facing toward and away from the longitudinal centerline of the bed;

c) a hollow sleeve having a central axis and at least one open end dimensioned for insertion therein of one of said side rail terminal ends; and d) second fastening means connecting said sleeve to said first support member outwardly adjacent said surface facing away from said bed centerline with said central axis positioned vertically and said open end facing upwardly to receive said side rail terminal end.

11. The combination of claim 10 wherein the surfaces facing toward the bed centerline of the two assemblies mounted adjacent the head of the bed are spaced by substantially said predetermined width, and the surfaces facing toward the bed centerline of the two assemblies mounted adjacent the foot of the bed are spaced by substantially said predetermined width.

12. The combination of claim 11 where each of said assemblies include a second support member attached to each of said first support member and said mattress supporting structure.

13. A support assembly for mounting adjacent the four corners of a bed in order to hold protective side rails having opposite, terminal ends along each side of the bed, said structure comprising:

a) first and second support members of flat, substantially rigid material having opposite, major surfaces; p1 first means for attaching said support members to a portion of said bed at one side and adjacent one end thereof with said opposite surfaces of said support members facing toward and away from, respectively, the centerline of said bed and for attaching said support members to one another;

c) a hollow sleeve having a central axis and opposite ends, at least one of said ends being open and dimensioned for insertion therein of one of said side rail terminal ends; and d) second means for detachably affixing said sleeve to said support members outwardly adjacent the surfaces facing away from the bed centerline with said axis positioned vertically and said open end facing upwardly to receive said side rail terminal end.

14. The support assembly of claim 13 wherein said means for attaching said support members to one another comprises fastening means extending through aligned openings in said first and second support members.

15. The support assembly of claim 14 wherein said first support member is generally T shaped.

* * * * *

UNITED STATES PATENT AND TRADEMARK OFFICE

CERTIFICATE OF CORRECTION

PATENT NO. : 6,799,340 B2
DATED : October 5, 2004
INVENTOR(S) : William M. Schatz It is certified that error appears in the above-identified patent and that said Letters Patent is hereby corrected as shown below:

Column 6,
Line 12, after the semi-colon ";", delete "p1".

Signed and Sealed this

Twenty-ninth Day of March, 2005

JON W. DUDAS
*Director of the United States Patent and Trademark Office*